US010334952B2

(12) United States Patent
Mezzera et al.

(10) Patent No.: US 10,334,952 B2
(45) Date of Patent: Jul. 2, 2019

(54) NO-TOOLS CHAIR HAVING DETACHABLE HEIGHT AND TILT CONTROL PADDLES

(71) Applicants: Marcelo Mezzera, Rancho Santa Margarita, CA (US); Alberto Palma, Costa Mesa, CA (US)

(72) Inventors: Marcelo Mezzera, Rancho Santa Margarita, CA (US); Alberto Palma, Costa Mesa, CA (US)

(73) Assignee: LF Products, LLC, Wilmington, DE (US)

( * ) Notice: Subject to any disclaimer, the term of this patent is extended or adjusted under 35 U.S.C. 154(b) by 0 days.

(21) Appl. No.: 16/008,726

(22) Filed: Jun. 14, 2018

(65) Prior Publication Data

US 2018/0289162 A1 Oct. 11, 2018

Related U.S. Application Data

(62) Division of application No. 15/230,925, filed on Aug. 8, 2016, now Pat. No. 10,021,982.

(51) Int. Cl.

| | |
|---|---|
| ***A47C 7/00*** | (2006.01) |
| ***A47C 7/54*** | (2006.01) |
| ***A47C 4/02*** | (2006.01) |
| ***A47C 3/30*** | (2006.01) |
| ***A47C 3/20*** | (2006.01) |
| ***A47C 7/40*** | (2006.01) |

(52) U.S. Cl.

CPC ..... *A47C 4/028* (2013.01); *A47C 3/20* (2013.01); *A47C 3/30* (2013.01); *A47C 4/021* (2013.01); *A47C 7/004* (2013.01); *A47C 7/006* (2013.01); *A47C 7/40* (2013.01); *A47C 7/54* (2013.01); *A61G 2203/10* (2013.01)

(58) Field of Classification Search

CPC ..... A47C 7/004; A47C 7/54; A61G 2203/00; A61G 2203/10

See application file for complete search history.

(56) References Cited

U.S. PATENT DOCUMENTS

| | | | | |
|---|---|---|---|---|
| 5,277,080 A * | 1/1994 | Roelle | A47C 1/024 | 56/10.5 |
| 6,067,874 A * | 5/2000 | Meissner | F16C 1/26 | 403/326 |
| 6,957,596 B2 * | 10/2005 | Kopetzky | B60N 2/66 | 188/17 |
| 7,303,236 B2 * | 12/2007 | Ritter | B60N 2/075 | 248/429 |

(Continued)

*Primary Examiner* — Timothy J Brindley
(74) *Attorney, Agent, or Firm* — Morland C. Fischer

(57) ABSTRACT

A chair is disclosed herein of the kind that is shipped disassembled in a compact shipping package to be assembled by the end user without the use of tools. The chair has a pair of user actuated height and tilt control paddles by which the elevation of the seat and the tilt of the seat and back of the chair can be adjusted relative to the base which holds the seat above the ground. In one embodiment, the height and tilt control paddles are removably attached to the seat at respective paddle receivers connected to the bottom of the seat. In another embodiment, the height and tilt control paddles are removably received by respective paddle cavities formed in the arms of the chair. By removing the paddles from their paddle receivers or paddle cavities, the parts of the disassembled chair may be more efficiently packaged for shipment.

7 Claims, 7 Drawing Sheets

(56) References Cited

U.S. PATENT DOCUMENTS

| | | | | |
|---|---|---|---|---|
| 7,475,944 | B2 * | 1/2009 | Griepentrog | A47C 17/175 297/328 |
| 7,694,930 | B2 * | 4/2010 | Ritter | B60N 2/146 248/408 |
| 7,866,751 | B2 * | 1/2011 | Downey | B60N 2/0296 297/344.24 |
| 7,914,077 | B2 * | 3/2011 | Linkner | B60N 2/01583 296/65.03 |
| 8,459,731 | B2 * | 6/2013 | Runde | B60N 2/856 297/61 |
| 8,864,224 | B2 * | 10/2014 | Kobayashi | B60N 2/3011 297/113 |
| 9,271,573 | B2 * | 3/2016 | Su | A47C 1/032 |
| 9,301,895 | B2 * | 4/2016 | Hough | A61G 5/14 |
| 9,395,076 | B2 * | 7/2016 | Wang | F21V 33/0004 |
| 9,402,478 | B2 * | 8/2016 | Hasegawa | A47C 1/023 |
| 9,539,919 | B2 * | 1/2017 | Pleskot | B60N 2/2356 |
| 9,693,634 | B2 * | 7/2017 | Smith | A47C 7/14 |
| 9,744,881 | B2 * | 8/2017 | Ferguson | B60N 2/04 |
| 9,808,394 | B1 * | 11/2017 | Jiang | A61H 3/04 |
| 2006/0087158 | A1 * | 4/2006 | Kramer | A47C 1/022 297/29 |
| 2009/0152915 | A1 * | 6/2009 | Krasna | A47C 1/0342 297/217.3 |
| 2016/0354263 | A1 * | 12/2016 | Furman | A61G 7/018 |
| 2017/0105540 | A1 * | 4/2017 | Jacobs | A47C 1/029 |
| 2017/0221350 | A1 * | 8/2017 | Hille | G08C 17/00 |
| 2017/0332804 | A1 * | 11/2017 | Rom | A47C 31/008 |

* cited by examiner

NO-TOOLS CHAIR HAVING DETACHABLE HEIGHT AND TILT CONTROL PADDLES

CROSS REFERENCE TO RELATED APPLICATIONS

This application is a division of patent application Ser. No. 15/230,925 filed Aug. 8, 2016.

BACKGROUND OF THE INVENTION

1. Field of the Invention

This invention relates to a chair of the kind that is preferably shipped disassembled in a compact shipping package to be assembled by the end user without the use of tools. User actuated height and tilt control paddles, which enable the position of the seat and back of the chair to be adjusted by a user of the chair relative to the chair base, are removably attached to and removable from either the bottom of the seat or the arms of the chair to enable the disassembled chair to be more efficiently packaged and consume less space.

2. Background Art

Large pieces of furniture, such as chairs and sofas, are typically shipped from a location of manufacture to a location of sale and finally to the public for use. The large and bulky nature of this furniture contributes to the purchase price paid by consumers. That is to say, as a consequence of its space-consuming size, relatively large shipping vessels are required to move the furniture from place to place. Moreover, relatively large storage facilities are necessary to accommodate the furniture while in transit from location-to-location. To overcome this problem, some articles of furniture (e.g., chairs) have been shipped disassembled in a space efficient container so that the final assembly can be completed by the end user.

One type of chair that has been shipped in a disassembled configuration is that having one or more user actuated controllers (sometimes referred to as paddles) which are operated by a user of the chair to cause the seat of the chair to be elevated and/or to tilt back to enhance the comfort of the user. Such controllers are fixedly connected to the chair to be within easy reach of and accessible to the user. The accessible location of such controllers has caused them to extend outwardly from the parts of the chair to which the controllers are connected. In this case, the space consumed by the controllers has made it difficult for the controllers along with the parts of the chair to which the controllers are connected to be efficiently packaged in a compact shipping container. Consequently, the size of the ship pine containers must be increased to accommodate the controllers which correspondingly increases the shipping cost which was intended to be reduced by virtue of packaging and shipping the chair in its disassembled configuration.

Accordingly, what would now be desirable is a means by which to ship the chair described above disassembled and without having to use a relatively large shipping container to accommodate the controllers which extend from parts of the chair.

SUMMARY

In general terms, chairs are disclosed of the kind that are preferably shipped disassembled in a compact shipping container to be assembled by the end user without the use of tools. Each chair has a seat to support the weight of a user, a base to support the seat above the ground, a back connected to and standing upwardly from the seat, and a pair of arms located at opposite sides of the seat. Each chair also has a user actuated height control paddle which is actuated by a user of the chair to cause the elevation of the seat to be adjusted relative to the base and a user actuated tilt control paddle which is actuated by the user by which the tilt of the seat and back of the chair can be adjusted relative to the base. Each of the user actuated height and tilt control paddles includes a rotatable handle and a cable that is coupled between the handle and one of a conventional gas cylinder or a conventional tilt control pin which communicates with the seat of the chair. When the handle of a paddle is rotated by the user of the chair, a corresponding pulling force is applied to the cable to either actuate the gas cylinder or pull the tilt control pin so that the position of the seat and back of the chairs relative to the base can be adjusted.

According to a first preferred embodiment, the height control and the tilt control paddles are removable attached to the seat of a first chair by respective paddle receivers connected to the bottom of the seat. Each paddle receiver includes a flat bottom, a pair of side walls standing upwardly from the flat bottom and having recessed locking channels formed therein, and a flexible locking tab rotatably connected at one end thereof to the flat bottom. Each paddle has a slide plate that is moved inwardly of the paddle receiver to slide over the flat bottom thereof. When the slide plate of the paddle moves inwardly of the paddle receiver, the slide plate rides through the locking channels of the side walls. At the same time, the flexible locking tab of the paddle receiver, which is initially rotated downwardly by the incoming slide plate towards the flat bottom of the paddle receiver, rotates upwardly into locking engagement with the slide plate by which to releasably retain the paddle in place within the paddle receiver that is attached to the bottom of the seat. The paddle can be removed from its paddle receiver when the user pushes down on the locking tab and slides the paddle outwardly from the paddle receiver.

According to a second preferred embodiment, the height control and the tilt control paddles are removably attached to respective arms of a second chair at paddle cavities that are formed in the arms. Each paddle cavity is covered by a removable arm cover. Each paddle cavity formed in each arm of the chair includes an outwardly extending locking slot and an inwardly extending locking tab. Each paddle has an anti-rotation stop projecting outwardly therefrom and a locking recess firmed therein. When a paddle is located within a paddle cavity, the anti-rotation stop of the paddle is received by the locking slot of the paddle cavity to prevent a rotation of the paddle when the handle thereof is rotated by the user. At the same time, the locking tab of the paddle cavity is received within the locking recess of the paddle by which to releasably retain the paddle in place within its paddle receiver. The paddle is removed from its paddle cavity by first inserting a tool through a tool access hole in the arm of the chair to push the locking recess of the paddle out of its receipt of the locking tab of the paddle cavity.

DESCRIPTION OF THE PREFERRED EMBODIMENT

Figure 1:
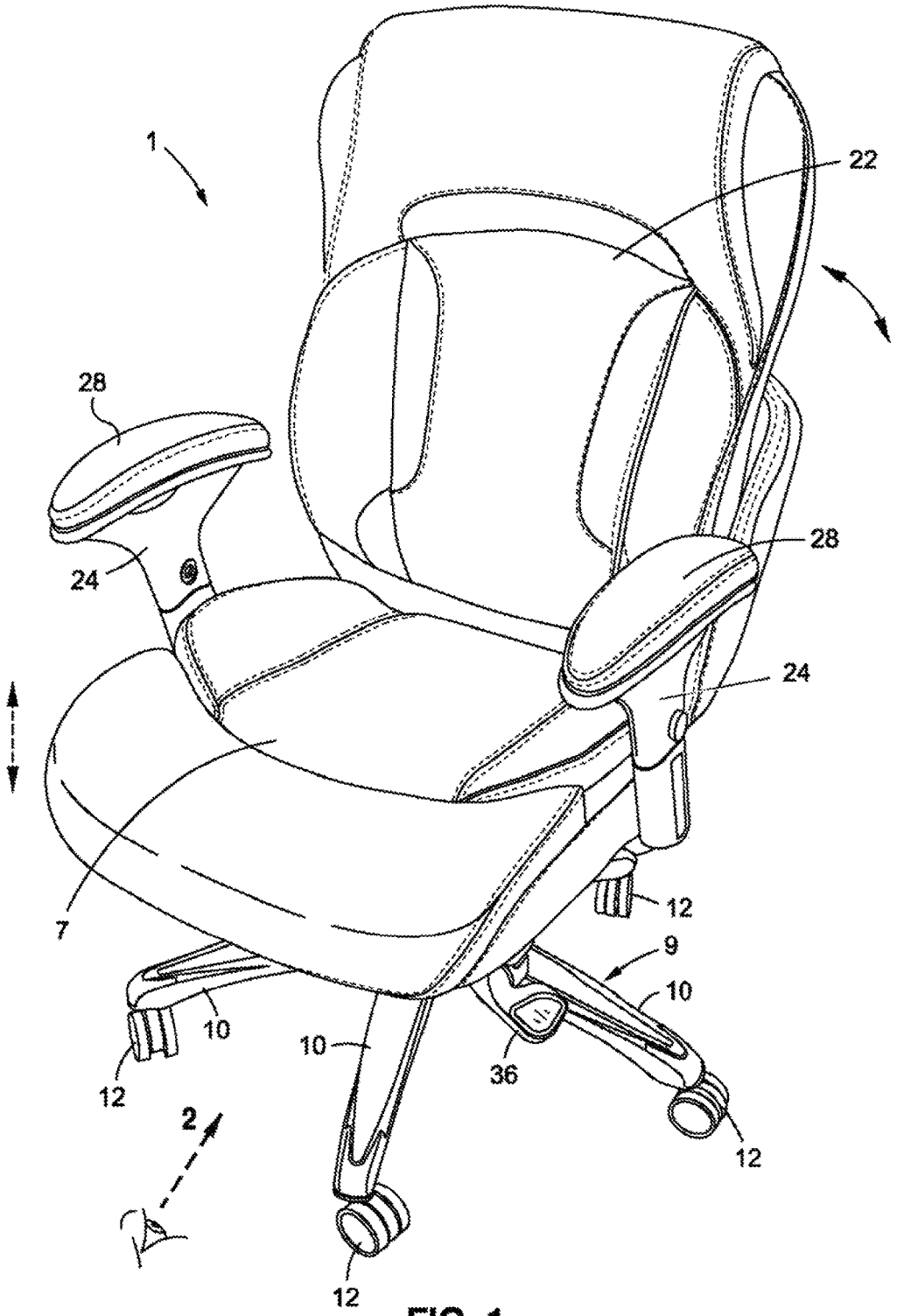
FIG. 1 shows a first no-tools chair having detachable height and tilt control paddles according to a first preferred embodiment of the invention.

A first preferred embodiment for a no-tools chair 1 having a pair of user actuated height and tilt control paddles (i.e., controllers) 3 and 5 is described while referring to FIGS. 1-6 of the drawings. The chair 1, which is preferably of the kind that is shipped disassembled to be subsequently assembled by the end user without the use of tools, has particular application for use in a home or office. However, it is to be understood that the advantages of this invention are also applicable to other kinds of chairs. The chair 1 includes a seat 7 to support the weight of the user. The seat 7 is held above the ground by a base 9 having a set of outstretched legs 10 to which respective rollers 12 are attached to permit the chair 1 to be moved from place-to-place. A conventional gas cylinder 14 (best shown in FIGS. 2 and 3) extends between the base 9 and a gas cylinder receiver (not shown) that lies below and is connected to the bottom of the seat 7. When the user activates the gas cylinder 14 as will be explained below, the elevation of the seat 7 relative to the base 9 can be adjusted to suit the needs of the user. A conventional tension adjustment knob 18 is accessible below a seat plate 20 that lies underneath the seat 7 and surrounds both the gas cylinder 14 and the tension adjustment knob 18. The user can rotate the tension adjustment knob 18 to adjust the spring tension of the seat 7 depending upon his size and weight.

The no-tool chair 1 also includes a back 22 that is connected to and stands upwardly from the seat 7. The back 22 and seat 7 are adapted to tilt back and forth with one another as the user shifts his weight in the chair 1. A pair of arms 24 are located at opposite sides of the seat 7. First ends of the arms 24 are connected by respective arm brackets 26 to the bottom of the seat 7, while the opposite ends of the arms 24 project above the seat 7 at which to support respective arm rests 28 upon which the arms of the user may be laid.

As will soon be disclosed, the user actuated height and tilt control paddles 3 and 5 of the no-tools chair 1 are removably attached to the bottom of the seat 7 so as to be conveniently located and readily accessible to the user seated on the seat 7. The paddles 3 and 5 enable the user to selectively control the height of the seat 7 above the chair base 9 as well as the ability of the seat 7 and back 22 to tilt back to enhance the user's comfort.

Figure 2:
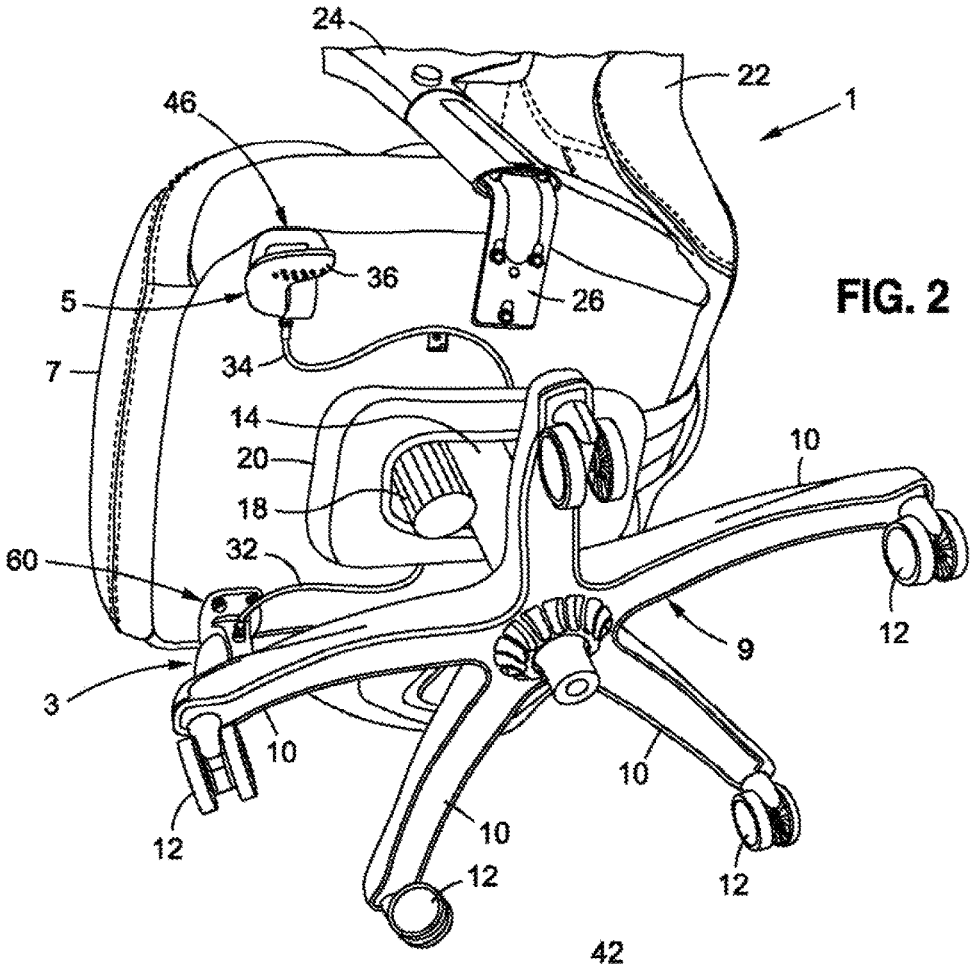
FIG. 2 shows the bottom of the chair of FIG. 1 and the tilt control paddle removably attached to a paddle receiver connected to the bottom of the seat of the chair.
Figure 3:
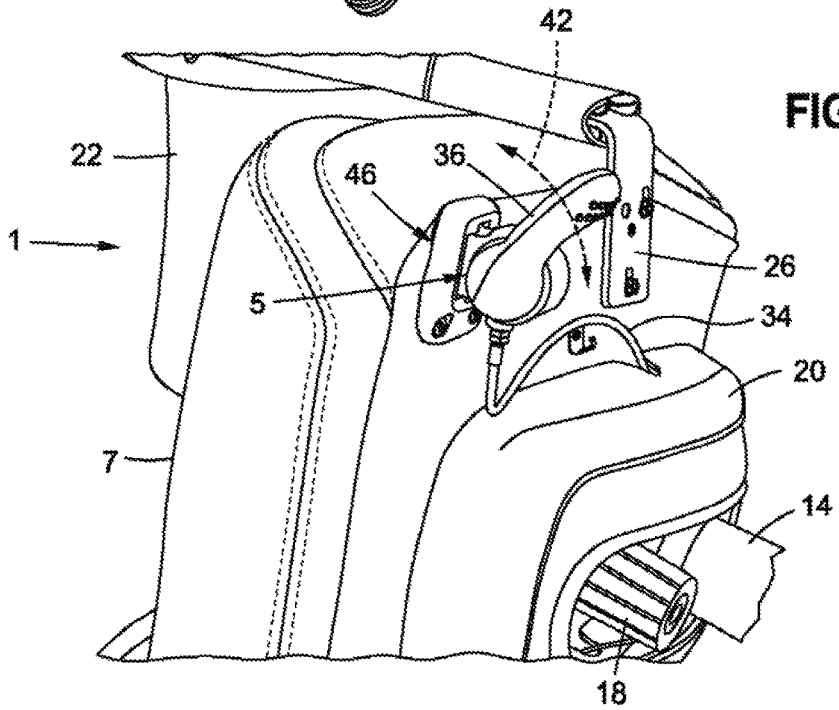
FIG. 3 is enlarged detail of the tilt control paddle shown in FIG. 2 removably attached to the paddle receiver that is connected to the bottom of the seat of the chair of FIG. 1.
Figure 4:
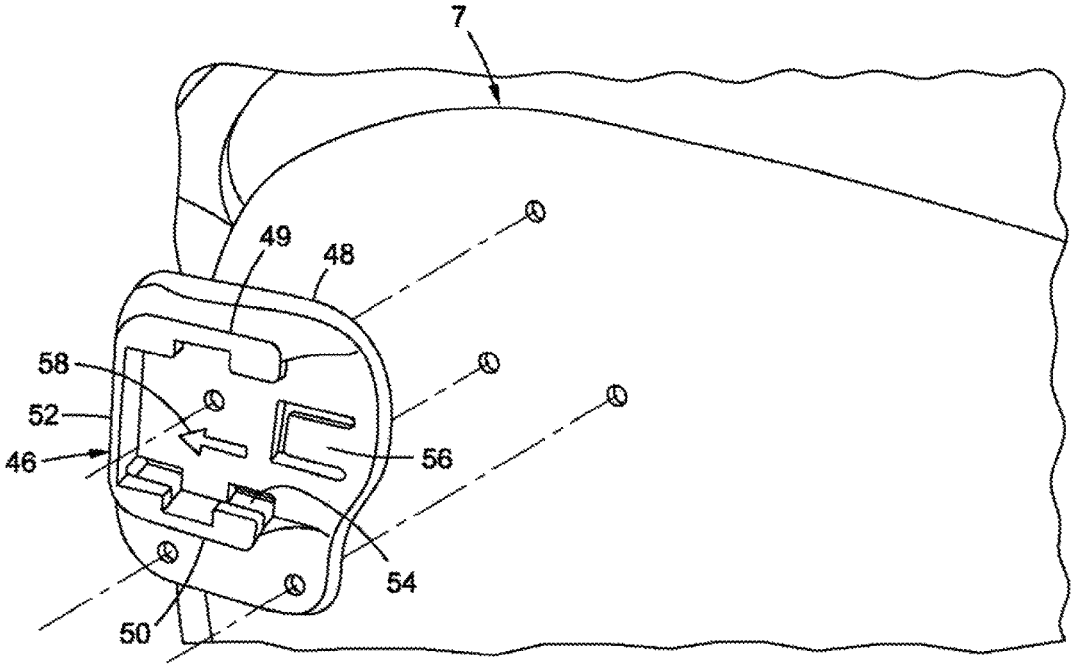
FIGS. 4 and 5 show the paddle receiver of FIGS. 2 and 3 connected to the bottom of the seat of the chair of FIG. 1.

Both the height and tilt control paddles 3 and 5 are identical and are known to chairs like that designated 1 in FIGS. 1-6. Therefore, only a brief description of one paddle (e.g., 5) will be provided below. As is best shown in FIG. 2, the height control paddle 3 is connected by way of a cable 32 to the gas cylinder 14. Actuating the height control paddle 3 causes a plunger (not shown) of the gas cylinder 14 to be forced under pressure outwardly from cylinder 14 and towards the chair seat 7 by which to correspondingly change the elevation of the seat 7 to which the gas cylinder is connected. The tilt control paddle 5 is connected by way of a cable 34 to a conventional tilt control pin (not shown) that is covered by the seat plate 20. Actuating the tilt control paddle 5 applies a pulling force to the tilt control pin to temporarily unlock the seat 7 and back 20 of the chair 1 from their normally stationary position so as to enable the seat and back to tilt back with one another relative to the chair base 9 when the user leans against the chair back 22.

Figure 6:
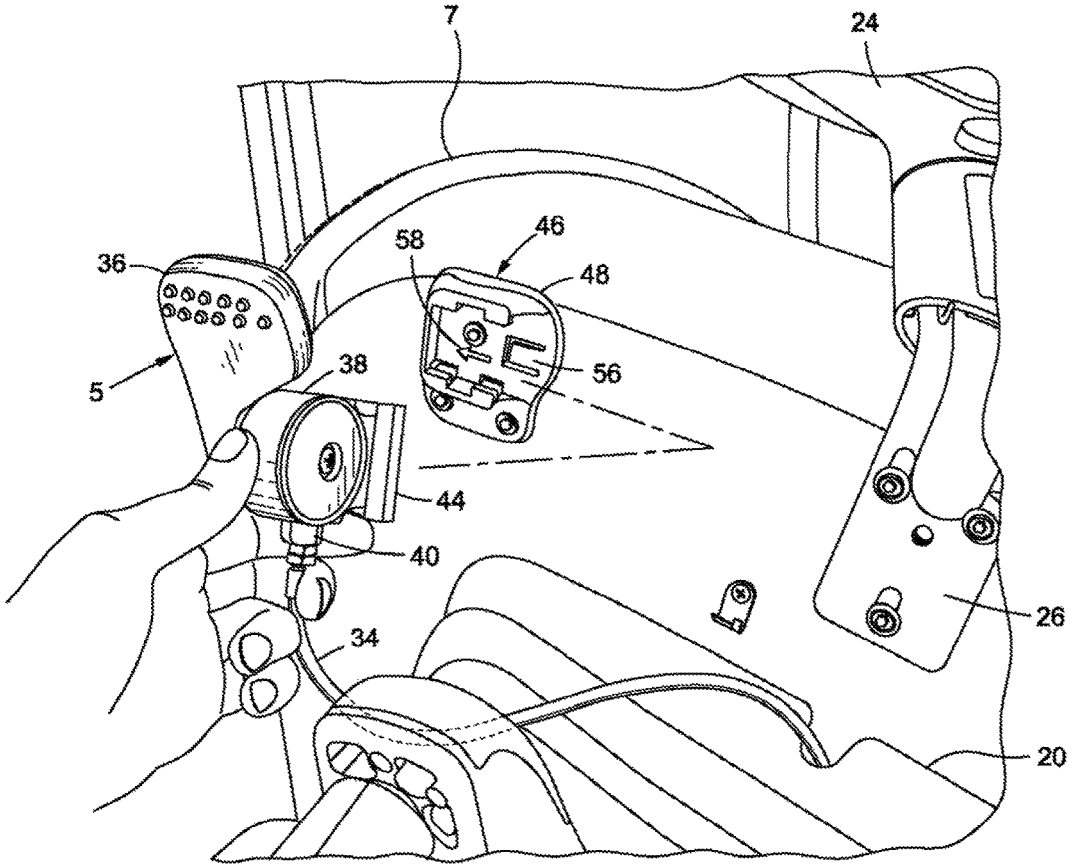
FIG. 6 shows the tilt control paddle of FIGS. 2 and 3 being removably attached to the paddle receiver of FIGS. 4 and 5.
Figure 8:
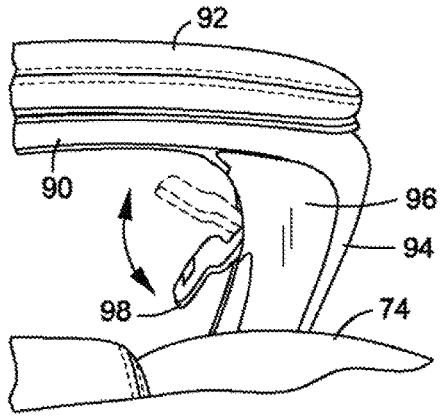
FIG. 8 is an enlarged detail of an arm cover lever that cooperates with an arm cover located at one arm of the chair shown in FIG. 7.
Figure 7:
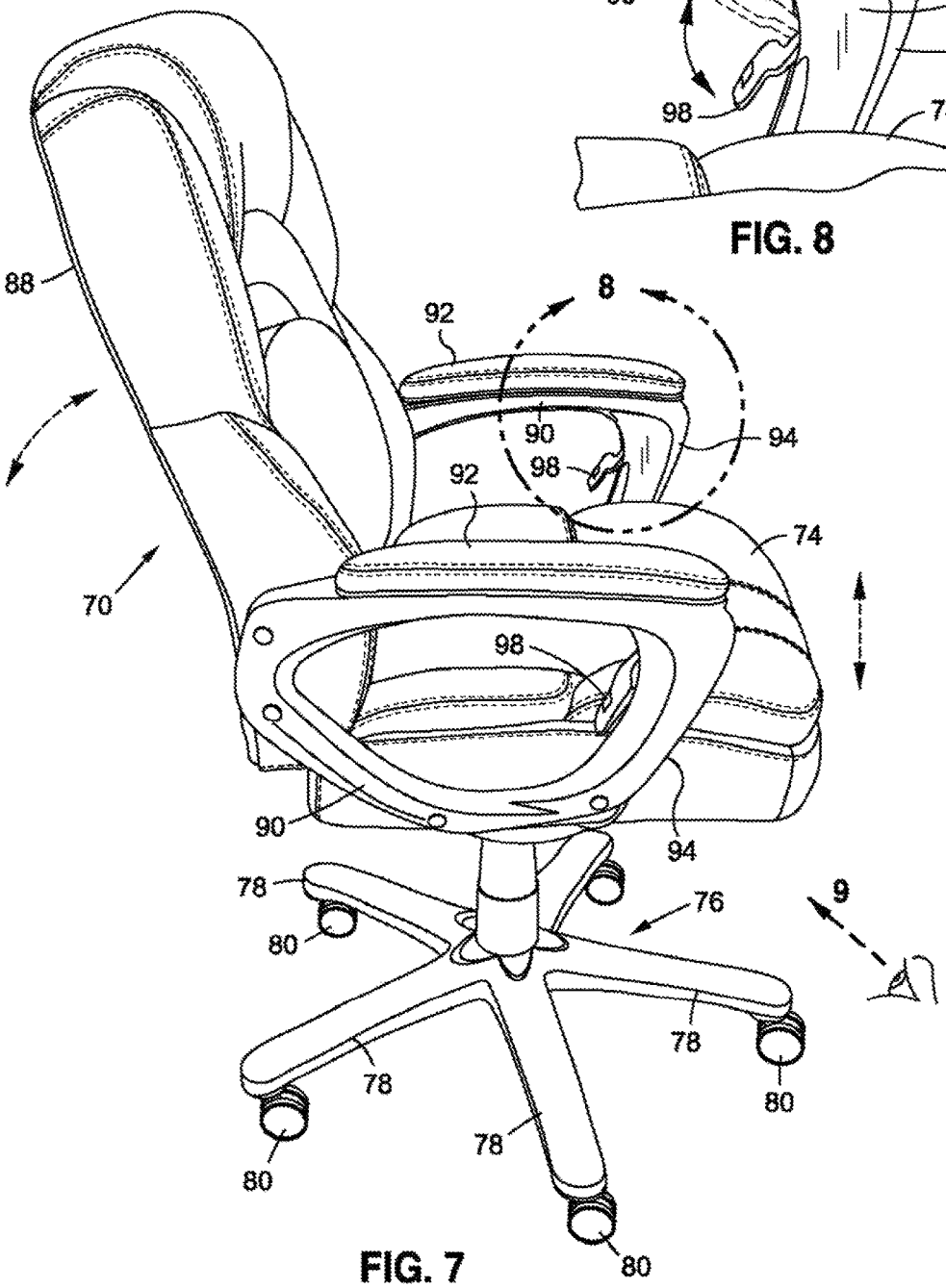
FIG. 7 shows a second no-tools chair having detachable height and tilt control paddles according to a second preferred embodiment of this invention.
Figure 9:
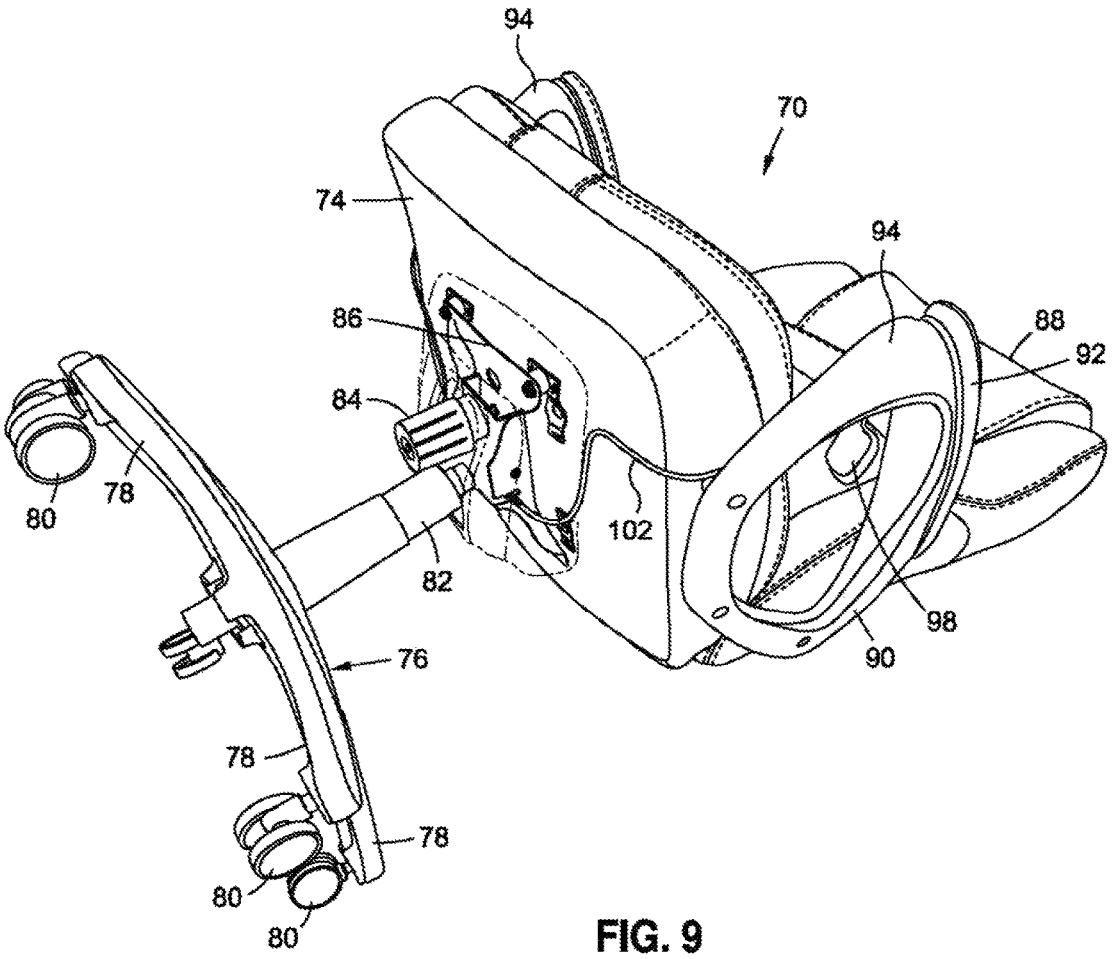
FIG. 9 shows the bottom of the chair of FIG. 7 to which the height and tilt control paddles are removably attached.

As is best shown in FIG. 6, each paddle (e.g. the tilt control paddle 5) includes a user actuated rotatable paddle arm 36. The rotatable paddle arm 36 is connected (by a fastener) to a paddle drum 38. The paddle drum 38 has an external fitting 40, and the aforementioned cable 34 runs from the fitting 40, along the bottom of the chair seat 7, through an opening in the seat plate 20, to the aforementioned tilt control pin. The rotatable arm 36 of the paddle 35 is coupled through the paddle drum 38 to the cable 34 at fitting 40. Thus, when the user applies a pushing force to the paddle arm 36, the paddle arm rotates relative to the drum 38 in one of the directions represented by the directional arrows 42 shown in FIG. 3 by which to cause a corresponding pulling force to be applied by way of the cable 34 to the tilt control pin below the seat 7 to enable the seat 7 and the back 22 of the chair 1 to tilt back when the user seated in the chair wishes to lean back.

A slide plate 44 (also best shown in FIG. 6) is attached to one side of the drum 38 of the paddle 5. The slide plate 44 is dimensioned to be slidably and removably received by a paddle receiver 46. In the case of the chair 1 shown in FIGS. 1-6, the paddle receiver 46 is affixed by means of fasteners to the bottom of the seat 7 (best shown in FIG. 4) so as to be in easy reach of the user.

Figure 5:
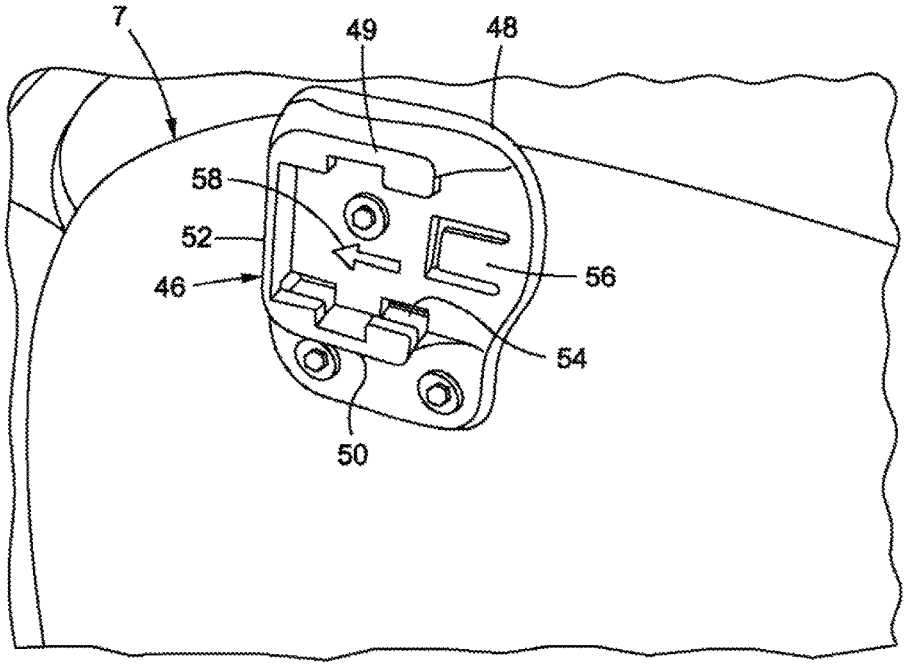

As is best shown in FIG. 5, the paddle receiver 46 includes a flat bottom 48 and an open front through which to receive the slide plate 44 of the paddle 5. The paddle receiver 46 also a pair of side walls 49 and 50 lying opposite one another and standing upwardly from the flat bottom 48. A rear wall 52 of the paddle receiver 46 also stands upwardly from the flat bottom 48 so as to lie between the side walls 49 and 50 opposite the open front. Each of the pair of side walls 49 and 50 of the paddle receiver 46 has a recessed locking channel 54 (only one of which being visible) formed therein and running longitudinally therealong. A flexible locking tab 56 is coextensively joined at one end thereof to the flat bottom 48 of the paddle receiver 46. The opposite free end of the locking tab 56 depends upwardly from and is rotatable relative to the paddle receiver bottom 48 in response to the slide plate 44 of the paddle 5 moving into mating engagement by the paddle receiver 46 and sliding over the locking tab 56.

Referring in this regard to FIGS. 5 and 6, the slide plate 44 of the paddle 5 is shown being moved into removable receipt by the paddle receiver 46. More particularly, the user pushes the front of the slide plate 44 of paddle 5 past the open front of paddle receiver 46 and across the flat paddle receiver bottom 48 thereof in the direction of the directional arrow 58. Accordingly, the slide plate 44 of paddle 5 will slide through the locking channels 54 in the side walls so as to move into abutment with the rear wall 52 of paddle receiver 46. At the same time, the flexible locking tab 56 which depends upwardly from the paddle receiver bottom 48 is initially bent downwardly by the incoming slide plate 44. The flexible locking tab 56 will then automatically bend upwardly relative to the paddle receiver bottom 48 so as to snap into locking engagement behind the back of the slide plate 44, whereby the paddle 5 is captured by and removably attached to the paddle receiver 46 at the bottom of the chair seat 7 (best shown in FIGS. 2 and 3).

With the paddle 5 attached to the bottom of the chair seat 7, the rotatable paddle arm 36 extends outwardly from one side of the seat 7 (best shown in FIGS. 1-3) so as to be grasped and manipulated (i.e., rotated) by one seated in the chair 1. Should he wish to hold it in his hand, the user can remove the paddle 5 from the paddle receiver 46. Likewise, with the no-tools chair 1 disassembled following its manufacture and ready to be shipped in a compact shipping container, the tilt control paddle 5 can also be removed from the paddle receiver 46. With the tilt control paddle 5 detached from the receiver 46 lying below the chair seat 7, the paddle arm 36 will not project outwardly from one side of the seat 7. Likewise, the other (height control) paddle 3 can be separated from the bottom of the seat 7 so that the peddle arm thereof will not project outwardly from the opposite side of the seat 7. By virtue of relocating the paddles 5 and 7, the area consumed by the chair seat 7 in its disassembled condition can be reduced to advantageously facilitate the seat 7 being efficiently packaged and shipped in a compact shipping container prior to the assembly of the chair by the end user.

The tilt control paddle 5 was described above as being removably attached to the paddle receiver 46 that is connected to the bottom of the chair seat 7 so as to lie at one side thereof. It is to be understood that the height control paddle 3 is removably attached to an identical paddle receiver (designated 60 and best shown in FIG. 2) that is also connected to the bottom of the seat 7 so as to lie at the opposite side thereof. Thus, one seated in the chair 1 can easily access and grasp one or the other of the paddles 3 or 5 with one of his hands.

Once a paddle (e.g., tilt control paddle 5 has been attached to its paddle receiver 46 below the chair seat 7, it can be removed from the receiver so that the paddle arm 36 thereof can be rotated by the user for a purpose described above. In this case, the user applies a downward pushing force against the flexible locking tab 56 of the paddle receiver 46 to cause locking tab 56 to bend downwardly towards the paddle receiver bottom 48. The user can then pull the paddle 5 outwardly from its receiver 46, such that the slide plate 44 will slide over and past the locking tab 56.

A second preferred embodiment for a no-tools chair 70 having a pair of user actuated height and tilt control paddles (only one of which 72 being shown) is described while referring to FIGS. 7-10 of the drawings. Like the chair shown in FIGS. 1-6, the chair 70 that is shown in FIGS. 7-10 includes a seat 74 that is held above the ground by a base 76 having a set of legs 78 to which rollers 80 are attached. A gas cylinder 82 is located below and cooperates with the seat 74 to enable the elevation of the seat relative to the base 76 to be adjusted by a user. A tension adjustment knob 84 projects below a seat plate housing 86 lying underneath the seat 74 to enable the user to adjust the spring tension of the seat 74. The chair 70 also includes a back 88 that is connected to and adapted to tilt back and forth with the seat 74 relative to the base 76.

A pair of arms 90 are located at opposite sides of the seat 74. The arms 90 are connected to the seat 74 and the back 88 of the chair 1 to support the user's arms on arm rests 92 which lie on top of the arms. Each arm 90 has a frontal arm support 94 that is connected to one side of the seat 74. In the example shown in FIGS. 7-10, the frontal arm support 94 of each arm 90 lies in front of and is spaced from the back 88 of chair 70.

Figure 10:
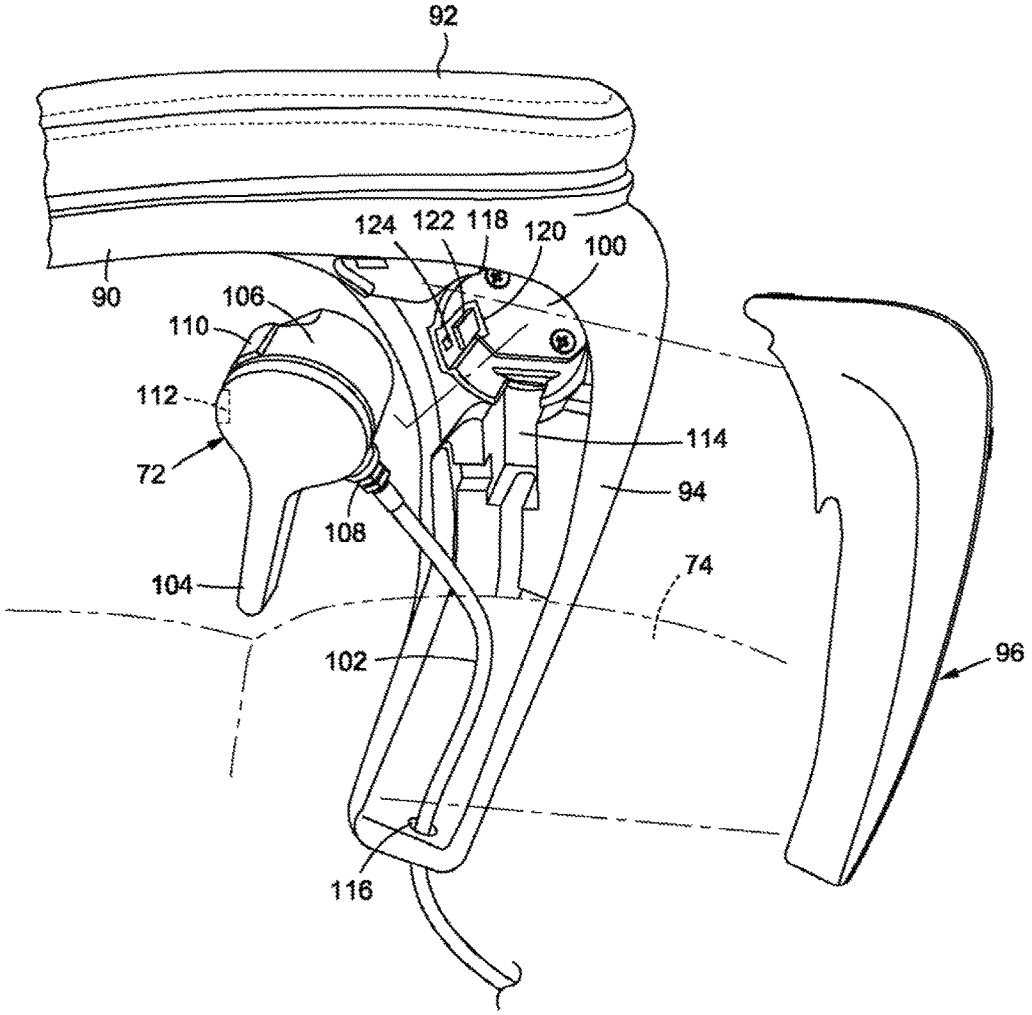
FIG. 10 is an exploded view showing the tilt control paddle being removably attached to a paddle cavity that is formed in one arm of the chair of FIG. 7 to be covered by a detachable arm cover.

As is best shown in and referring particularly to FIG. 10, each arm 90 has a decorative arm cover 96 that is removably attached to (i.e., snapped into engagement with) the frontal arm support 94 so as to lie adjacent one side of the seat 74. The removable arm cover 96 lies over and covers a paddle cavity 100 that is formed in the frontal arm support 94 so that the user actuated paddle 72 can be removably received therewithin. An arm cover lever 98 (best shown in FIG. 8) is interactive with the arm cover 96 located at the frontal arm support 94 of arm 90. The arm cover lever 98 is rotatable in one of the directions illustrated by the directional arrows of FIG. 8 to correspondingly cause the arm cover 96 to be detached from the front arm support 94 so as to enable the user to gain access to the paddle cavity 100 covered by arm cover 96.

The paddle 72, which is user actuated to control either the height of the seat 74 or the simultaneous tilt of the seat 74 and the back 88 of the chair 70, is coupled by way of a cable 102 to either a plunger (not shown) of the gas cylinder 82 or to a tilt control pin (also not shown) located underneath the chair seat 74. As is best shown in FIG. 10, the paddle 72 includes a user actuated rotatable paddle arm 104. The rotatable paddle arm 104 is connected and rotatable relative to a cylindrical drum 106. The paddle drum 106 has an external fitting 108 to which the cable 102 is connected. The cable 102 runs from the drum fitting 108, along the bottom of the chair seat 74 and, by way of an opening (of FIG. 9) formed in the seat plate housing 86, to one of the aforementioned gas cylinder 82 or tilt control pin below housing 86.

Thus, when the user applies a pushing force to the paddle arm 104, the paddle arm rotates relative to the paddle drum 106 to cause a corresponding pulling force to be applied to the cable 102 at the fitting 108 that is coupled between the paddle drum 106 and the cable 102. The pulling force applied to the cable 102 in turn causes either the piston of the gas cylinder 82 to move under pressure outwardly from the cylinder 82 and thereby adjust the elevation of the seat 74 or the tilt control pin to be pulled to permit the simultaneous rotation of the chair seat 74 and the chair back 88 relative to the chair base 76.

The paddle 72 also includes an anti-rotation stop 110 projecting outwardly from one side of the drum 106. A locking recess 112 is formed in another side of the drum 106 of paddle 72. The purpose of the anti-rotation stop 110 and the locking recess 112 for retaining the paddle 72 within the paddle cavity 100 formed in the frontal arm support 94 of one of the arms 90 of the chair 70 will soon be explained.

Continuing to refer to FIG. 10, details are now provided of one of the paddle cavities 100 that is formed in a respective one of the front arm supports 94 of the pair of arms 90 of the chair 70 within which to removably receive one of the pair of user actuated paddles (e.g., paddle 72). A cable channel 114 is formed in the frontal arm support 94 to communicate with the paddle cavity 100. The cable channel 114 is dimensional to accommodate therewithin the cable 102 and the fitting 108 which couples the cable to the paddle drum 106. The cable channel 114 is preferably axially aligned with a cable thru-hole 116 that is formed in the bottom of the frontal arm support 94 through which the cable 102 is fed prior to its run along the bottom of the chair seat 74.

The paddle cavity 100 ideally has a cylindrical configuration to match the shape of the cylindrical drum 106 of paddle 72. An anti-rotation locking slot 118 is recessed within and extends radially outward from one side of the paddle cavity 100. Recessed within a different side of the paddle cavity 100 is a locking channel 120. Standing upwardly within the locking channel 120 is a flexible locking tab 122 that is adapted to be pressed in a radially outward direction relative to the cylindrical paddle cavity 100. Lying adjacent the locking tab 122 within the locking channel 120 is a tool access hole 124. The tool access hole 124 extends completely through the frontal arm support 94 so as to communicate with the paddle cavity 100 at the locking channel 120 thereof.

With the aforementioned arm cover lever 98 (of FIG. 8) rotated and the arm cover 96 detached and removed from the frontal arm support 94 of the chair arm 90, the paddle 72 can now be removably received within the paddle cavity 100. To this end, the paddle drum 106 is pushed inwardly of the cavity 100 so that the cable 102 and the drum fitting 108 are located within the cable channel 114. At the same time, the anti-rotation stop 110 carried by the paddle drum 106 is located within the anti-rotation locking slot 118 which extends outwardly from the paddle cavity 100 to prevent a rotation of the paddle drum 106 within cavity 100. Likewise, the locking recess 112 formed in the paddle drum 106 is moved over and into locking engagement with the flexible locking tab 122 that stands upwardly within the locking channel 120 of cavity 100, whereby to hold the paddle drum 106 in place within the paddle cavity 100. The user is now able to apply a pushing force to cause the paddle arm 104 to rotate relative to the paddle drum 106 which remains stationary within cavity 100 as a result of the engagement of the anti-rotation stop 110 of drum 106 by the anti-rotation locking slot 118 of cavity 100.

It may be desirable to remove the paddle 72 from the paddle cavity 100 such as when the user wishes to hold the paddle 72 in his hands and rotate the paddle arm 104 or when it is desirable to pack the arms 90 of the no-tools chair 70 in a compact shipping container after the chair has been manufactured but before the chair has been assembled by the end user. In this case, the chair arms 90 can be shipped while separated from the remainder of the chair and without the rotatable paddle arms 104 extending therefrom and interfering with an efficient packaging. To accomplish the foregoing, a suitable tool (not shown) is pushed through the tool access hole 124 to engage and press the flexible locking tab 122 out of its receipt by and locking engagement with the locking recess 112 of the paddle drum 106. The disengaged paddle 72 is now free to be pulled outwardly and removed from the paddle cavity 100 formed in the frontal arm support 94 of the chair arm 90.

The invention claimed is:

1. A chair comprising a seat to support the weight of a user, a base to bold the seat above the ground, a pair of arms located at opposite sides of the seat, a user actuated controller that is operable by the user of said chair to cause the position of the seat to be adjusted relative to the base, said user actuated controller being removably attached to one of the pair of arms of said chair, wherein the one of said pair of arms of said chair to which said user actuated controller is removably attached has a controller cavity formed therein, said user actuated controller being removably received within said controller cavity, and an arm cover detachably connected to the one of the pair of arms of said chair in which said controller cavity is formed, said arm cover lying over said controller cavity and covering said user actuated controller removably received therewithin.

2. The chair recited in claim 1, further comprising seat position adjustment means located below the seat of said chair and connected to said user actuated controller by which the position of the seat is adjusted relative to the base in response to the user of said chair operating said user actuated controller.

3. The chair recited in claim 2, wherein said user actuated controller includes a cable connected to said seat position adjustment means and a rotatable handle coupled to said cable, such that a rotation of said rotatable handle by the user of the chair causes a corresponding pulling force to be applied to said cable by which to operate said seat position adjustment means and thereby adjust the position of the seat of said chair relative to the base thereof.

4. The chair recited in claim 1, further comprising an arm cover lever cooperating with said arm cover, such that a pushing force applied to said arm cover lever by the user of said chair causes said arm cover to be detached from the one of the pair of arms of said chair which said controller cavity is formed.

5. The chair recited in claim 3, wherein said controller cavity has a locking slot formed therein and said user actuated controller has an anti-rotation stop extending therefrom, said anti-rotation stop being removably received by said locking slot when said user actuated controller is removably received within said controller cavity so as to prevent a rotation of said user actuated controller in said controller cavity in response to a rotation of the rotatable handle of said user actuated controller by the user of said chair.

6. The chair recited in claim 1, wherein said controller cavity has a locking tab extending inwardly thereof and said user actuated controller has a locking recess formed therein, said locking tab being removably received by said locking recess when said user actuated controller is removably received within said controller cavity so as to hold said user actuated controller within said controller cavity.

7. The chair recited in claim 6, further comprising a tool access hole extending through the one of the pair of arms of said chair in which said controller cavity is formed so as to communicate with said controller cavity, said tool access hole being sized to receive a tool therethrough by which to engage said user actuated controller that is removably received within said controller cavity and thereby push said locking recess out of its removable receipt of said locking tab so that said user actuated controller can be removed from said controller cavity.

* * * * *